US006406208B1

(12) United States Patent
Hsu

(10) Patent No.: US 6,406,208 B1
(45) Date of Patent: Jun. 18, 2002

(54) FILE BINDER STRUCTURE

(76) Inventor: Yu-Hsien Hsu, 2FL.-2, No. 2, Lane 96, Hsing Long Rd., Sec. 2, Taipei (TW)

( * ) Notice: Subject to any disclaimer, the term of this patent is extended or adjusted under 35 U.S.C. 154(b) by 0 days.

(21) Appl. No.: 09/994,878

(22) Filed: Nov. 28, 2001

(51) Int. Cl.[7] ..... B42F 3/06

(52) U.S. Cl. ..... 402/57; 24/67 R; 281/27.1; 402/17; 402/70; 402/80 R; 402/500; D19/27

(58) Field of Search ..... 281/21.1, 27.1; 402/60, 57, 70, 15, 17, 80 R, 500; 24/67 R, 67 P, 67.11; D19/27

(56) References Cited

U.S. PATENT DOCUMENTS

| | | | | | |
|---|---|---|---|---|---|
| 1,163,766 | A | * | 12/1915 | Morden | 402/20 |
| 2,144,581 | A | * | 1/1939 | Trussell | 281/27.2 |
| 2,200,146 | A | * | 5/1940 | Block | 281/27.2 |
| 2,583,998 | A | * | 1/1952 | Cook | 281/19.1 |
| 3,956,798 | A | * | 5/1976 | Wright | 281/27.1 |
| 4,832,370 | A | * | 5/1989 | Jones | 281/27.2 |
| 6,113,298 | A | * | 9/2000 | Miro | 281/27.2 |

FOREIGN PATENT DOCUMENTS

| | | | |
|---|---|---|---|
| DE | 4126327 | * | 2/1993 |

* cited by examiner

*Primary Examiner*—A. L. Wellington
*Assistant Examiner*—Monica Carter
(74) *Attorney, Agent, or Firm*—Bacon & Thomas, PLLC

(57) ABSTRACT

File binder structure including multiple bent hooks arranged side by side. One end of the bent hooks is integrally connected together by a connecting strip. The other end of the bent hooks is bent into short plates. A stop slat with I-shaped cross-section is connected to the open end of the bent hooks. The connecting strip and short plates are respectively inserted into two channels formed on two sides of the stop slat. The bent hooks are conducted through the row of holes of the papers and then the stop slat is fitted with the short plates of the bent hooks and the connecting strip to fix the papers. It is very easy to assemble the stop slat with the bent hooks and disassemble the stop slat from the bent hooks. Therefore, it is very convenient to increase or decrease the number of the papers or replace the papers.

1 Claim, 3 Drawing Sheets

FILE BINDER STRUCTURE

BACKGROUND OF THE INVENTION

The present invention is related to a file binder structure which enables a user to quickly connect and locate papers and conveniently increase or decrease the number of the papers or replace the papers.

Conventional notebooks can be divided into fixed type and loose-leaf type. With respect to the fixed type notebook, one side of the papers is integrally stitched with a string. With respect to the loose-leaf type, a plastic coil or a semicircular metal binder is conducted through a row of holes of the papers, whereby the papers are fixed and can be turned. The conventional fixing measures both have some shortcomings. With respect to fixed type, the number of papers cannot be increased or decreased as necessary. With respect to the loose-leaf type, although the number of papers can be increased or decreased as necessary, it is uneasy to assemble or disassemble the coil or binder.

SUMMARY OF THE INVENTION

It is therefore a primary object of the present invention to provide a file binder structure including multiple bent hooks arranged side by side. One end of the bent hooks is integrally connected together by a connecting strip. A stop slat with I-shaped cross-section is connected to the open end of the bent hooks. The above structure has the following advantages:

1. The stop slat can be easily drawn away from the bent hooks to disassemble the file binder structure.
2. It is very easy to assemble the stop slat with the bent hooks to connect and locate the papers which can be turned for easy reading. Also, it is very easy to disassemble the stop slat from the bent hooks. Therefore, it is very convenient to increase or decrease the number of the papers or replace the papers.

The present invention can be best understood through the following description and accompanying drawings wherein:

DETAILED DESCRIPTION OF THE PREFERRED EMBODIMENT

Figure 1:
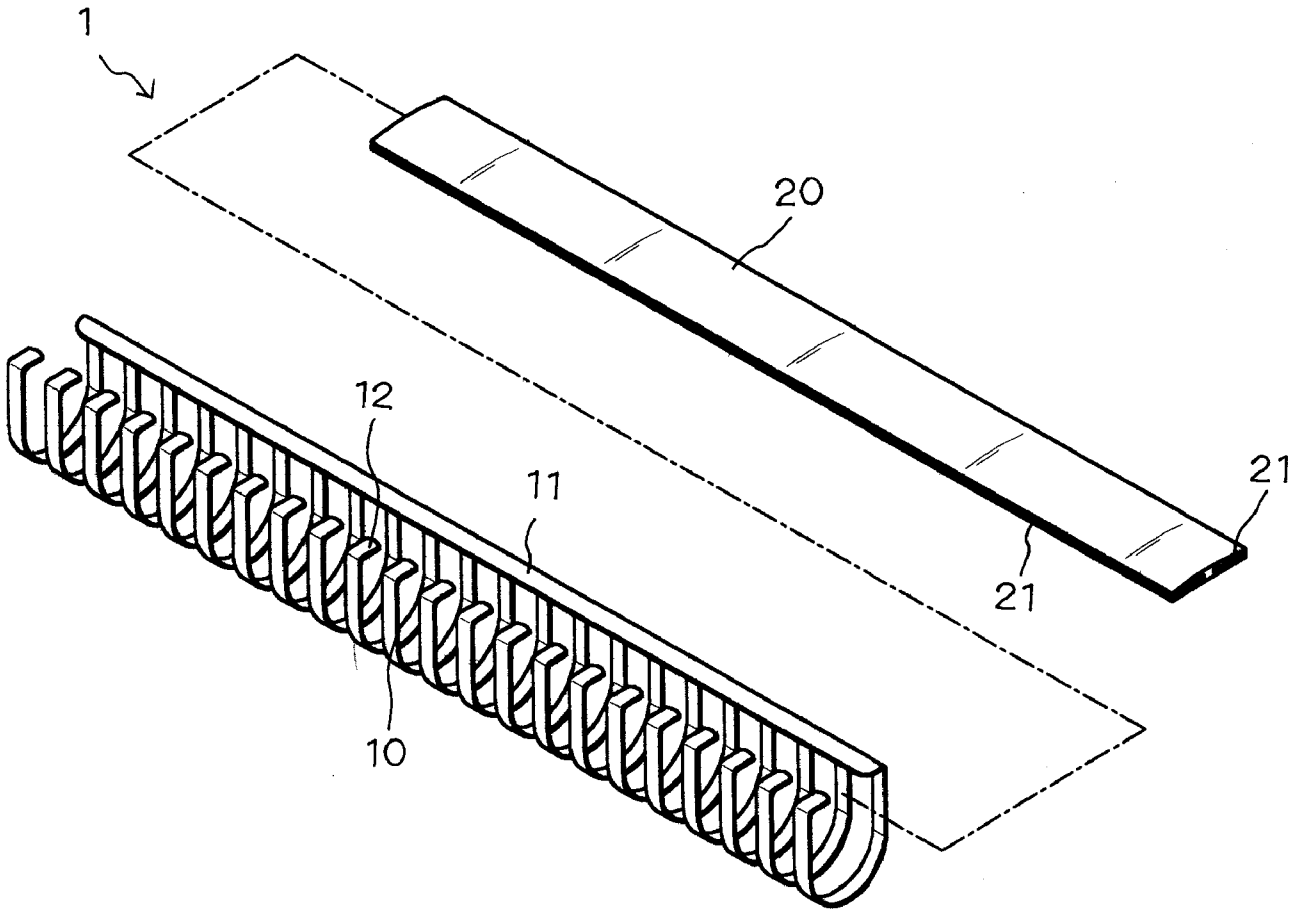
FIG. 1 is a perspective exploded view of the file binder structure of the present invention.
Figure 2:
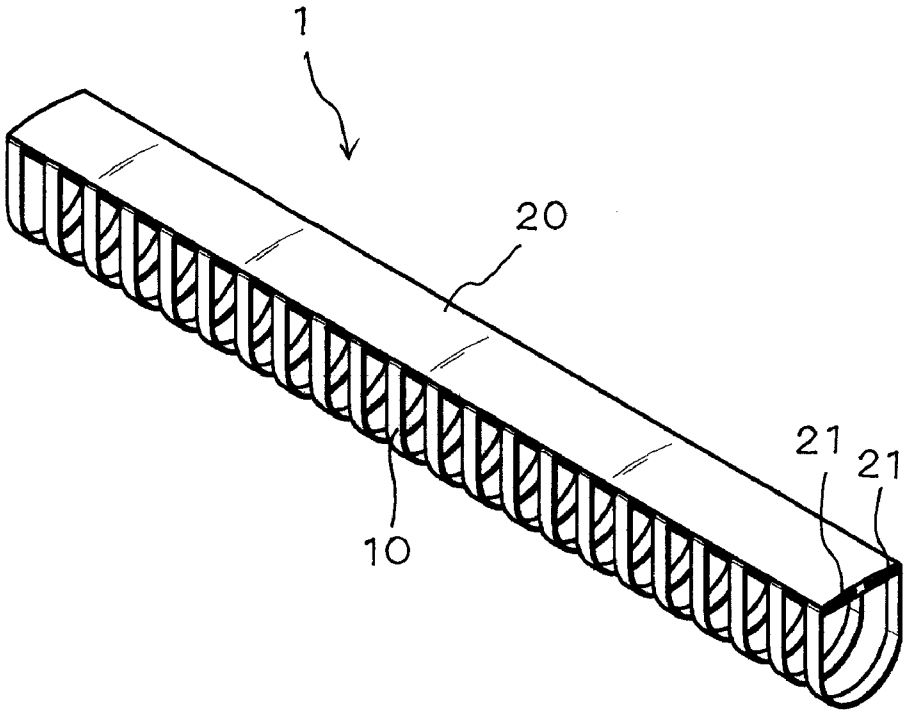
FIG. 2 is a perspective assembled view of the file binder structure of the present invention.

Please refer to FIGS. 1 and 2. The file binder structure 1 of the present invention has multiple bent hooks 10 arranged side by side. One end of the bent hooks 10 is integrally connected together by a connecting strip 11. The other end of the bent hooks 10 is bent to form an inward extending short plate 12. A stop slat 20 with I-shaped cross-section is connected to the open end of the bent hooks 10. The connecting strip 11 and short plates 12 are respectively inserted into two channels 21 formed on two sides of the stop slat 20.

Figure 3:
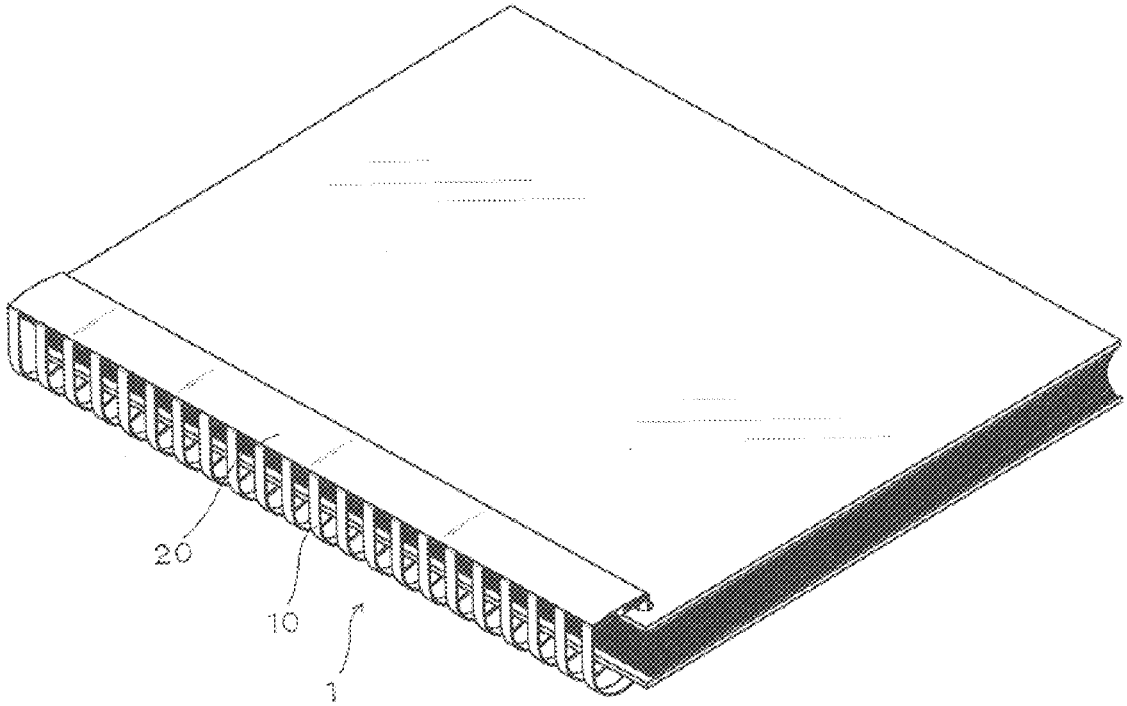
FIG. 3 is a perspective view showing that papers are connected by the file binder structure of the present invention.

In actual use, as shown in FIG. 3, the bent hooks 10 are conducted through the row of holes of the papers and then the stop slat 20 is fitted with the short plates 12 of the bent hooks 10 and the connecting strip 11. At this time, the papers are connected and located and can be turned for easy reading. The stop slat 20 can be easily detached from the bent hooks 10 for increasing or decreasing the number of the papers.

According to the above arrangement, it is very easy to assemble the stop slat 20 with the bent hooks 10 and disassemble the stop slat 20 from the bent hooks 10. Therefore, it is very convenient to increase or decrease the number of the papers or replace the papers.

The above embodiment is only used to illustrate the present invention, not intended to limit the scope thereof. Many modifications of the above embodiment can be made without departing from the spirit of the present invention.

What is claimed is:

1. File binder structure comprising multiple bent hooks arranged side by side, one end of the bent hooks being integrally connected together by a connecting strip, the other end of the bent hooks being bent into short plates, a stop slat with I-shaped cross-section being connected to the open end of the bent hooks, the connecting strip and short plates being respectively inserted into two channels formed on two sides of the stop slat.

* * * * *